US011388964B2

(12) United States Patent
Perez et al.

(10) Patent No.: US 11,388,964 B2
(45) Date of Patent: Jul. 19, 2022

(54) LUGGAGE AND RELATED TRAVEL EQUIPMENT

(71) Applicants: Keyler Rodriguez Perez, Miami, FL (US); Jorge L Yanes, Miami, FL (US); Neal Rosenblum, Miami, FL (US)

(72) Inventors: Keyler Rodriguez Perez, Miami, FL (US); Jorge L Yanes, Miami, FL (US); Neal Rosenblum, Miami, FL (US)

(73) Assignee: GATO, LLO, Miami, FL (US)

( * ) Notice: Subject to any disclaimer, the term of this patent is extended or adjusted under 35 U.S.C. 154(b) by 209 days.

(21) Appl. No.: 16/547,761

(22) Filed: Aug. 22, 2019

(65) Prior Publication Data

US 2021/0052051 A1 Feb. 25, 2021

(51) Int. Cl.

| | |
|---|---|
| ***A45C 5/14*** | (2006.01) |
| ***A45C 13/26*** | (2006.01) |
| ***A45C 13/38*** | (2006.01) |
| ***A45C 13/04*** | (2006.01) |

(52) U.S. Cl.

CPC ..... *A45C 5/146* (2013.01); *A45C 13/04* (2013.01); *A45C 13/262* (2013.01); *A45C 13/385* (2013.01); *A45C 2013/267* (2013.01)

(58) Field of Classification Search

CPC ..... A45C 5/146; A45C 13/262

See application file for complete search history.

(56) References Cited

U.S. PATENT DOCUMENTS

| | | | | |
|---|---|---|---|---|
| 1,259,305 | A * | 3/1918 | Shwayder | A45C 13/04 190/123 |
| 7,097,181 | B2 * | 8/2006 | Sadow | A45C 13/262 190/18 A |
| 7,246,805 | B2 * | 7/2007 | Neal | A45C 13/385 280/37 |
| 2006/0273534 | A1 * | 12/2006 | Turner | A45F 4/02 280/30 |
| 2008/0217130 | A1 * | 9/2008 | Louis | A45C 9/00 190/18 A |
| 2010/0175960 | A1 * | 7/2010 | Moskowitz | A45C 13/30 190/11 |
| 2011/0247910 | A1 * | 10/2011 | Darvish | A45C 13/385 190/18 A |
| 2015/0208776 | A1 * | 7/2015 | Bennett | A45C 13/385 190/15.1 |
| 2018/0360183 | A1 * | 12/2018 | Steinkraus | A45C 5/14 |

* cited by examiner

*Primary Examiner* — John K Fristoe, Jr.
*Assistant Examiner* — Justin Caudill
(74) *Attorney, Agent, or Firm* — Trueba & Suarez, PLLC; Roberto M. Suarez, Esq.

(57) ABSTRACT

An integrated luggage apparatus includes: a rear shell, a front shell hingedly attached to the rear shell by a hinged attachment, a cart base fixedly attached to a bottom of the rear shell; a cart frame pivotally attached to the cart base; at least one wheel assembly; and a handle assembly. When the front shell is rotated about a hinged attachment and comes into contact with the rear shell, both the front shell and the rear shell define a space for a person to pack personal items, such as clothing.

5 Claims, 16 Drawing Sheets

LUGGAGE AND RELATED TRAVEL EQUIPMENT

CROSS-REFERENCE TO RELATED APPLICATIONS

None.

FIELD OF THE INVENTION

The invention disclosed broadly relates to the field of luggage and more specifically relates to luggage with a built-in cart.

BACKGROUND OF THE INVENTION

Travelers with more than one item of luggage have choices in how they transport multiple articles of luggage. One choice is to rent a baggage cart such as the SmartEeCarte® baggage cart provided for rent in many airports throughout the United States. Another choice is to hand the luggage over to a skycap or porter at the airport to physically transport multiple articles of luggage and/or other travel equipment/articles/accessories using proprietary airport luggage cart equipment. Still other travelers opt to strap their luggage together using luggage straps or bungees. The drawback to the first two options is the cost involved. The drawback to the third option is the inability to properly contain and secure the multiple articles of luggage while moving through the airport. Without a proper method of securing the articles of luggage, they can topple over.

SUMMARY OF THE INVENTION

Briefly, according to an embodiment of the disclosure, an integrated luggage conveyor set includes: a luggage housing; a handle mechanism; and a conveyor cart assembly mechanically attached to the luggage housing. The conveyor cart assembly includes at least: a frame coupled to the luggage housing, a wheel assembly coupled to the frame, and a hinge mechanism pivotally attaching the frame to the luggage housing.

According to another embodiment of the disclosure, a luggage apparatus includes: a rear shell; a front shell hingedly attached to the rear shell by a hinged attachment; a cart base fixedly attached to a bottom of the rear shell; a cart frame pivotally attached to the cart base; at least one wheel assembly; and a handle assembly. When the front shell is rotated about a hinged attachment and comes into contact with the rear shell, both the front shell and rear shell define a space for a person to pack personal items, such as clothing.

Throughout the instant disclosure, certain terms and phrases are used to convey the invention or parts of the invention. In some cases, multiple words may be used to convey the same structure. For example, "luggage" may also be referred to as "baggage" or "suitcase" yet these words refer to the same structure.

BRIEF DESCRIPTION OF THE SEVERAL VIEWS OF THE DRAWINGS

To describe the foregoing and other exemplary purposes, aspects, and advantages, we use the following detailed description of an exemplary embodiment of the invention with reference to the drawings, in which.

Figure 16:
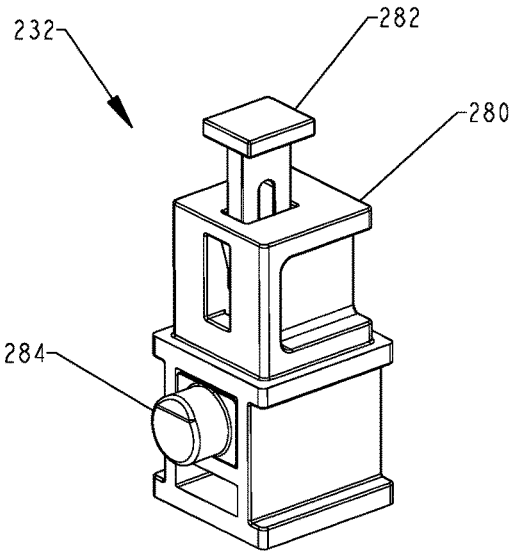
FIG. 16 shows a lock pin mechanism, according to an embodiment of the present disclosure.
Figure 17:
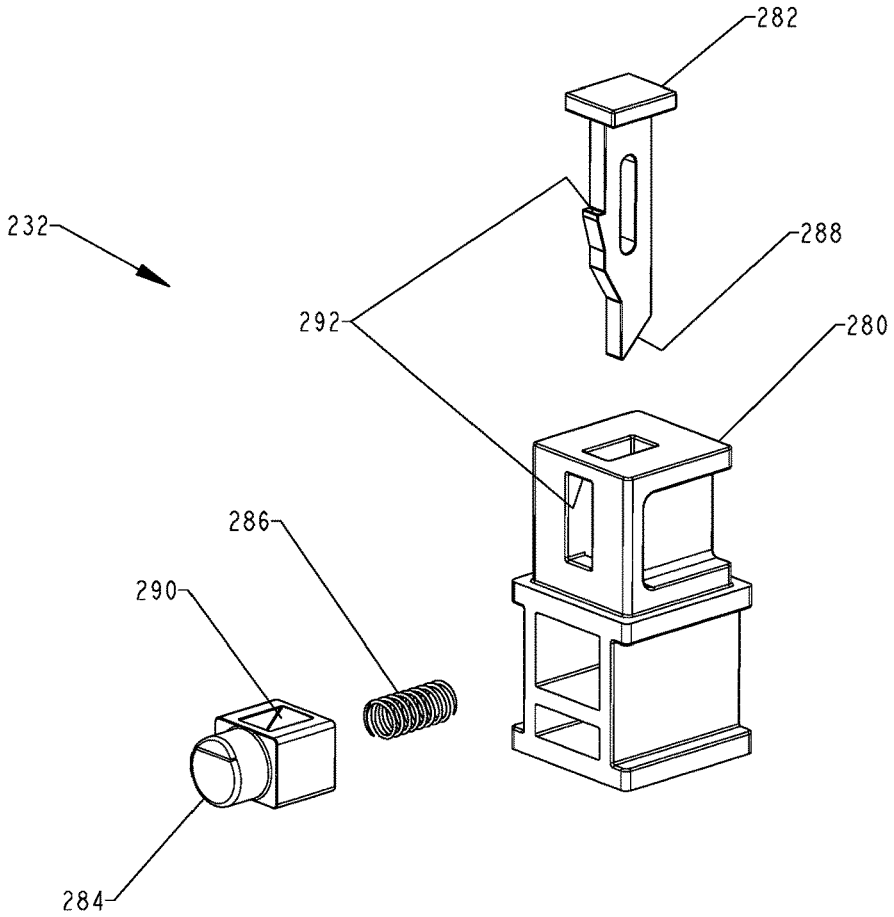
Figure 18:
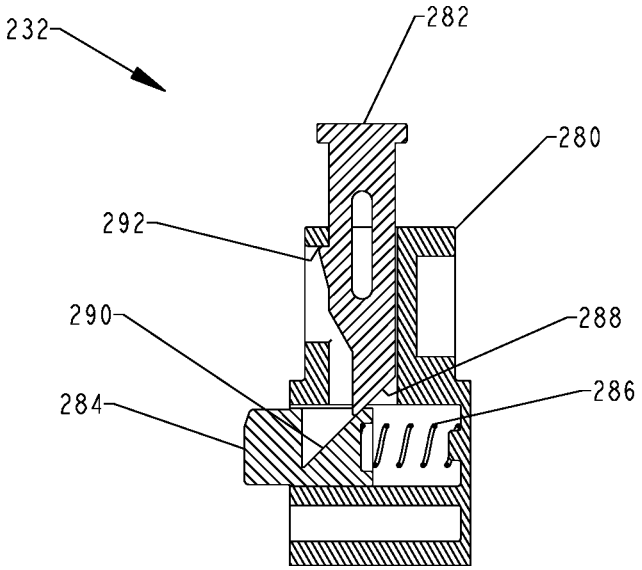
Figure 19:
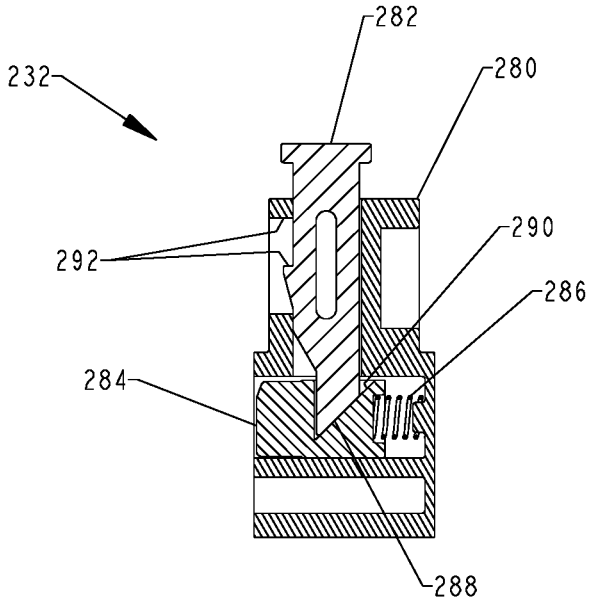

FIG. **16*a* shows a front view of the lock pin mechanism of FIG. 16**, according to an embodiment of the present disclosure;

FIG. 17 shows an exploded view of the lock pin mechanism of FIG. 16, according to one embodiment of the present disclosure;

FIG. 18 shows a cross-sectional view of the lock pin mechanism of FIG. 16, according to one embodiment of the present disclosure; and FIG. 19 shows the cross-sectional view of FIG. 18, in an engaged positional state, according to one embodiment of the present disclosure.

While the invention as claimed can be modified into alternative forms and still remain within the scope and spirit of the invention, a preferred embodiment thereof is shown in the drawings and will herein be described in detail, by way of example. It should be understood, however, that the drawings and detailed description thereto are not intended to limit the invention to the particular form disclosed, but on the contrary, the intention is to cover all modifications, equivalents and alternatives falling within the scope of the present invention.

DETAILED DESCRIPTION

We describe a luggage-conveyor set that overcomes the above-stated shortcomings of the known art. According to a preferred embodiment of the present disclosure, a suitcase coupled with an integral luggage conveyor cart forms the principle components of an integrated luggage cart system (ILCS). With the ILCS, one person can easily and securely transport multiple articles of different sizes, with minimal effort, without the need for a separate cart or trolley. In addition, other travel articles/accessories, such as pet carriers and crates, child seats, strollers, and the like, can be secured to the luggage conveyor cart and easily transported along with the suitcase. Table 1, below, lists the ILCS components and their respective element numbers.

TABLE 1

Index of ILCS Features

| INDEX | PART/FEATURE DESCRIPTION |
|---|---|
| 100 | LUGGAGE |
| 102 | CART STRUCTURE/ASSEMBLY |
| 104 | HANDLE ASSEMBLY |
| 106 | MAIN LUGGAGE STRUCTURE |
| 108 | LUGGAGE LID |
| 110 | ILCS COVER |
| 112 | ZIPPER, LUGGAGE LID |
| 114 | ZIPPER, ILCS COVER |
| 116 | MAIN LUGGAGE WHEELS (CASTERS) |
| 118 | CART REAR WHEELS (CASTERS) |
| 120 | CART FRONT WHEEL (CASTERS) |
| 122 | CART FRAME |
| 124 | FRONT LIP |
| 126 | FRONT WHEEL BRACKET ASSEMBLY |
| 128 | REAR WHEEL BRACKET ASSEMBLY |
| 130 | FRONT WHEEL BRACKET ASSEMBLY LOCK SHAFT |
| 132 | REAR WHEEL BRACKET ASSEMBLY LOCK SHAFT |
| 134 | BOTTOM PLATE |
| 136 | BOTTOM BRACKET |
| 138 | OUTBOARD HINGE KNUCKLE |
| 140 | INBOARD HINGE KNUCKLE |
| 142 | WHEEL BRACKET ASSEMBLY RELEASE PIN ACCESS HOLE |
| 144 | CART FRAME CLEARANCE CUT |
| 146 | CART STRAP |
| 148 | STOWED LOCK PIN HOLE |
| 150 | DEPLOYED LOCK PIN HOLE |
| 152 | WHEEL ASSEMBLY PIVOT MECHANISM |
| 154 | WHEEL PIVOT BEARING BRACKET |
| 156 | FRONT WHEEL BRACKET |
| 158 | REAR WHEEL BRACKET |
| 160 | PIVOT PIN |
| 162 | PIVOT PIN RETURN SPRING |
| 164 | PIVOT PIN HOUSING |
| 166 | PIVOT PIN RETAINING PIN OR COTTER PIN |
| 168 | SPACER |
| 170 | ATTACHMENT SCREW |
| 172 | RETAINING NUT |
| 176 | PULL RING |
| 178 | SNAP RING |
| 180 | WHEEL ASSEMBLY LOCK SHAFT RETURN SPRING |
| 182 | WHEEL ASSEMBLY LOCK SHAFT HOUSING |
| 200 | PLENUM |
| 202 | UPPER HANDLE ENCLOSURE |
| 204 | LOWER HANDLE ENCLOSURE |
| 206 | TELESCOPING RELEASE BUTTON |
| 208 | TELESCOPING LOCK PIN |
| 210 | TELESCOPING LOCK HOLE |
| 212 | TELESCOPING TUBE UPPER |
| 214 | TELESCOPING TUBER LOWER |
| 216 | PIVOT TUBE |
| 218 | RETURN SPRING (TORSION SPRING) |
| 220 | COLLAR |
| 222 | COUPLER |
| 224 | BUMPER |
| 226 | TELESCOPING RELEASE BUTTON SPRING |
| 228 | PUSH ROD |
| 230 | PUSH ROD TIP |
| 232 | LOCK PIN MECHANISM |
| 234 | PIVOT BEARING |
| 236 | PIVOT TUBE PIVOT MECHANISM |

TABLE 1-continued

Index of ILCS Features

| INDEX | PART/FEATURE DESCRIPTION |
|---|---|
| 238 | STIFFENER ROD |
| 240 | RIVET ATTACHMENT HOLES |
| 242 | RIVET |
| 244 | HANDLE ATTACHMENT SCREW |
| 246 | TORSION SPRING ENGAGEMENT HOLE, PIVOT TUBE |
| 248 | TORSION SPRING ENGAGEMENT HOLE, PLENUM |
| 250 | PIVOT TUBE LOCK SHAFT |
| 252 | PULL RING |
| 254 | SNAP RING |
| 256 | PIVOT TUBE LOCK SHAFT RETURN SPRING |
| 258 | PIVOT TUBE LOCK SHAFT HOUSING |
| 260 | PIVOT TUBE RETENTION LOCK PIN |
| 262 | PIVOT TUBE RETENTION LOCK PIN RETURN SPRING |
| 264 | PIVOT TUBE RETENTION LOCK PIN HOUSING |
| 266 | PIVOT TUBE RETENION LOCK PIN RETAINER PIN |
| 268 | HANDLE ASSEMBLY INDEXING BOSS |
| 270 | HANDLE ASSEMBLY VERTICAL LOCK HOLE |
| 272 | PIVOT BEARING HOLE |
| 280 | LOCK BODY |
| 282 | WEDGE PUSHER |
| 284 | LOCK BUTTON |
| 286 | COMPRESSION SPRING |
| 288 | WEDGE BEARING SURFACE, PUSHER |
| 290 | WEDGE BEARING SURFACE, LOCK BUTTON |
| 292 | WEDGE PUSHER RETAINING SNAP FEATURES |

Figure 1:
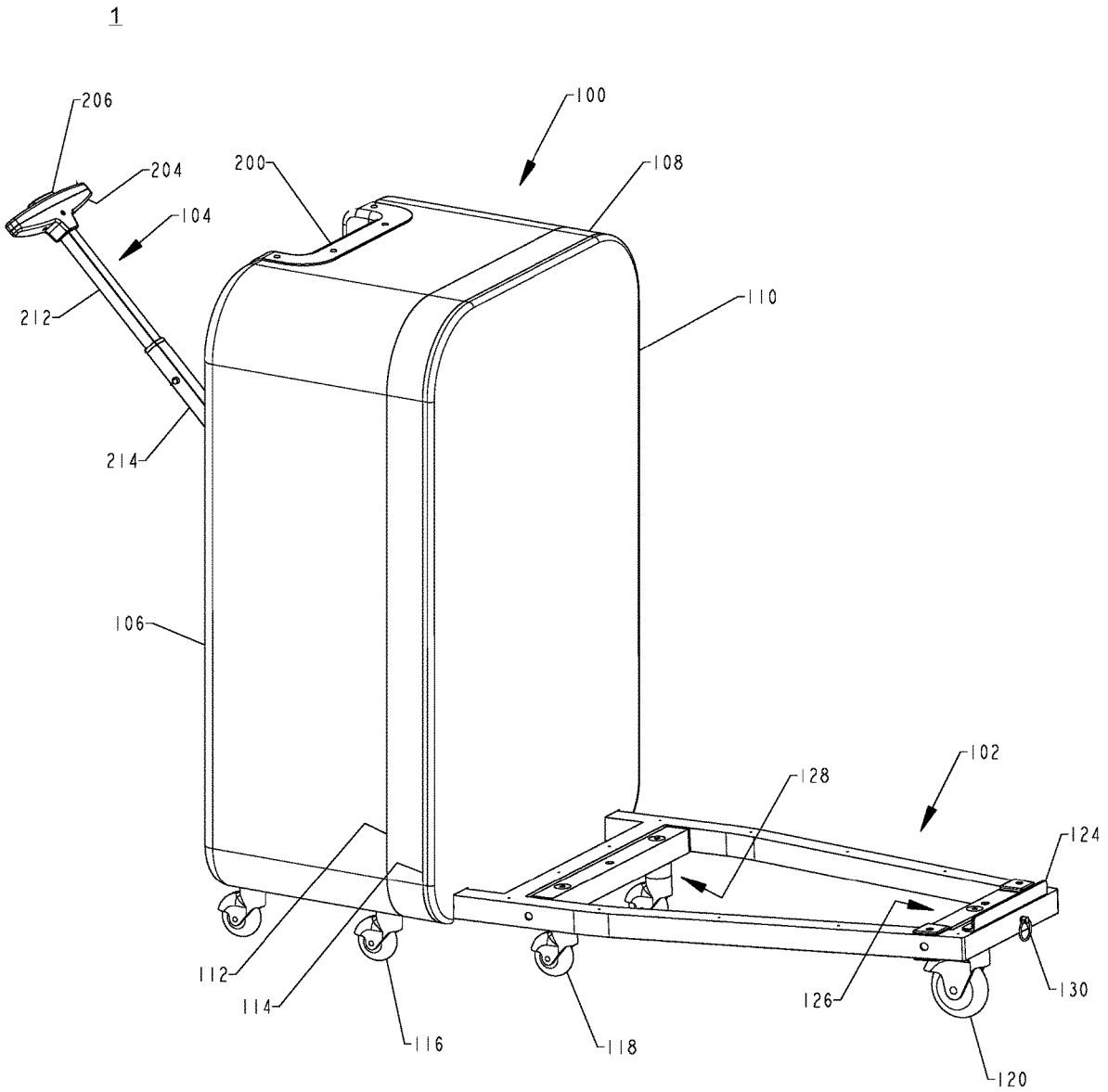
FIG. 1 shows a front perspective view of an integrated luggage cart system (ILCS) with an integrated luggage cart in the deployed state, according to an embodiment of the present disclosure.

Referring now to the drawings in general and to FIG. 1 in particular, there is shown a preferred embodiment illustrating an ILCS in the deployed state. The ILCS includes an article of luggage 100, such as the suitcase shown in FIG. 1, coupled with an integral luggage cart assembly 102. We use the term "suitcase" for simplicity and ease of understanding. One with knowledge in the art will appreciate that the article of luggage 100 is not limited to a suitcase, but can be embodied as a backpack, a carry-on bag, a garment bag, a stroller, a kennel, and the like. The article of luggage 100 of FIG. 1 can be a hard-sided or soft-sided item and can be of different sizes and shapes.

In an embodiment, the main luggage structure 106 of the article of luggage 100 includes a rear shell and a front shell. The front shell is hingedly attached via a hinged attachment to the rear shell. When the front shell, or luggage lid 108, is pivoted about the hinged attachment, it comes into contact with the rear shell, defining a space where a person's belongings, such as clothes, can be packed. The rear shell bottom includes a cart base with a cart base pivot location extending past the hinged attachment, away from the back of the rear shell. The rear shell includes at least one wheel assembly 116 attached at the bottom of the rear shell.

A luggage cart assembly 102 is mechanically coupled with the luggage 100 and is configurable between a stowed state and a deployed state. In FIG. 1 the luggage cart assembly 102 is shown in the deployed state. The luggage cart assembly 102 includes a cart frame 122 with at least one frame member and a cart frame pivot location pivotally attached to a cart base pivot location.

The ILCS is configured to accommodate multiple articles of luggage when they are placed on the luggage cart assembly 102. The additional articles are not shown so as not obscure the component parts of the luggage cart assembly 102. When the luggage cart assembly 102 is deployed, it forms a sturdy platform for transporting multiple articles of luggage. The luggage articles can be placed side-by-side and/or stacked. The luggage articles can be tethered to provide additional stability and theft deterrence. In this manner, a simple item of luggage 100 becomes an expand-able luggage conveyor, able to accommodate multiple articles of luggage, as well as, strollers, kennels, or other items.

The luggage 100 includes a luggage lid 108 as part of the main luggage structure or body 106. The luggage 100 can be opened and closed by manipulating the luggage lid 108 via an attachment means such as the zipper 112 shown in FIG. 1. The attachment means is not limited to a zipper 112. In one embodiment, the luggage lid 108 contains a cover 110 that conceals the stowed luggage cart assembly 102. The cover 110 also has an attachment means such as a zipper 114 to attach it to the lid 108. The luggage 100 also includes a conveyance mechanism such as wheels 116 and a handle mechanism 104. The wheels shown in FIG. 1 are swivel wheels (casters); however, one with knowledge in the art will appreciate that other types of wheels can be advantageously employed to provide ease of mobility to the luggage 100.

Figure 2:
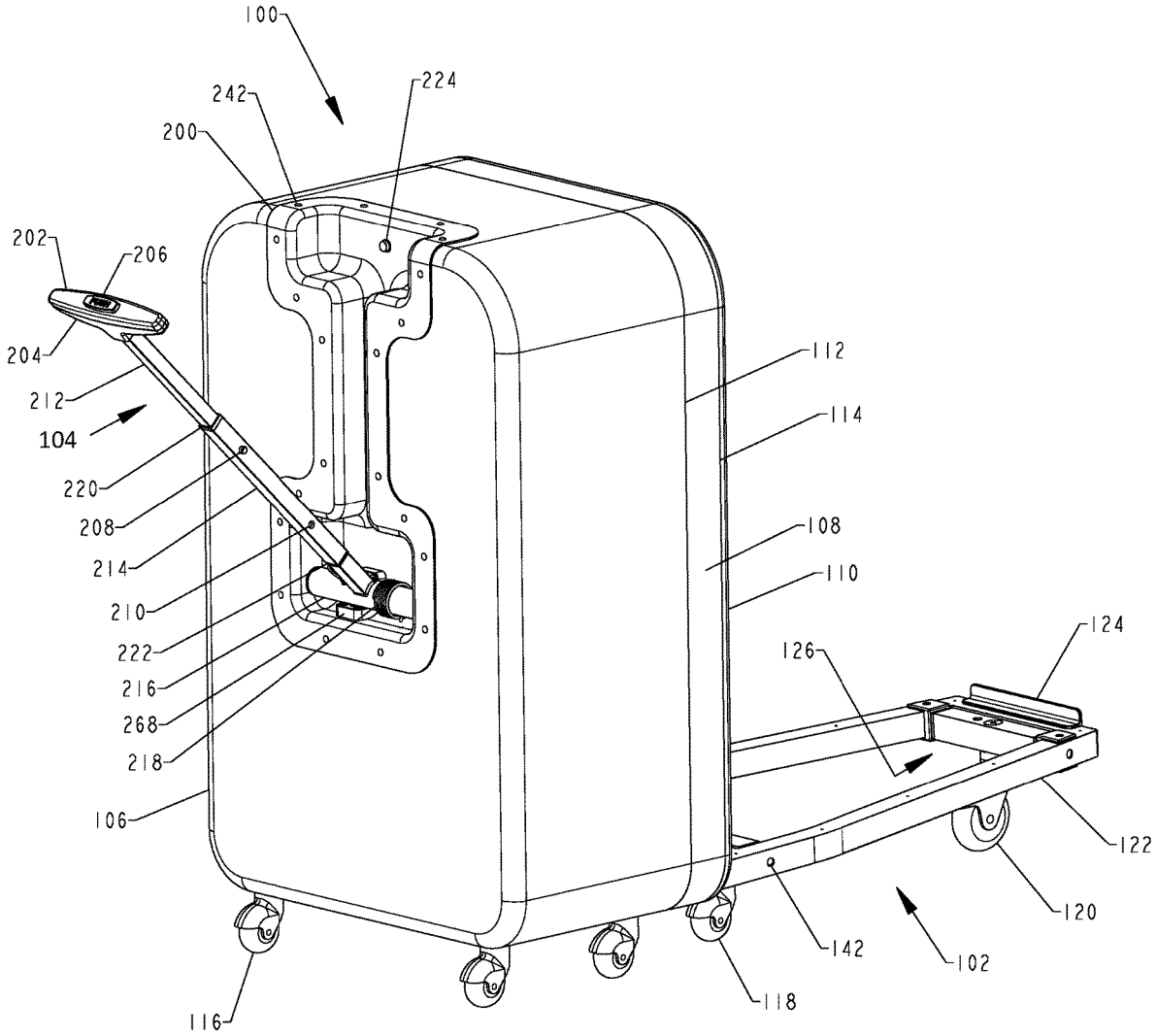
FIG. 2 shows a back perspective view of the ILCS of FIG. 1, according to an embodiment of the present disclosure.

The handle mechanism 104 is shown in the deployed state in FIGS. 1 and 2, and in the stowed state in FIGS. 3-7. In the embodiment shown in FIG. 1, the handle mechanism 104 is disposed within a plenum 200 when stowed. By way of example and not limitation, the handle mechanism 104 includes a telescoping tube with an upper portion 212 and a lower portion 214. A telescoping release button 206 is shown in the handle assembly 104. It is within the scope of the present invention that the handle does not necessarily have to be a telescoping mechanism as shown in FIG. 1. The handle can also be formed from a rigid, one-piece construction, or a strap.

The wheeled luggage cart assembly 102 provides an easy and lightweight transport mechanism for the suitcase 100 and any other articles of luggage that are placed on the cart 102. By way of example, and not limitation, the luggage cart assembly 102 includes a front wheel 120 attached to the frame 122 via a front wheel bracket assembly 126 and two rear wheels 118 attached via a rear wheel bracket assembly 128.

In FIG. 1, the luggage cart assembly 102 is shown in the deployed state, with the proximal end of the luggage cart assembly 102 extending out from the luggage 100. In the embodiment shown in FIG. 1, the proximal portion of the frame 122 of the luggage cart 102 is mechanically coupled to the bottom of the luggage 100, while the distal portion remains unattached. In one embodiment, a hinge mechanism is provided to articulate the luggage cart 102 from the stowed to deployed positions (and back).

By way of example and not limitation, the luggage cart assembly 102 shown in FIG. 1 tapers toward the distal, or terminating, end. A front lip 124 is included to stabilize luggage items that are placed on the luggage cart 102. A front wheel bracket assembly lock shaft 130 is used to position the front wheel 120 in the stowed or deployed positions. FIG. 2 shows a rear perspective view of the ILCS of FIG. 1, with the luggage cart assembly 102 in the deployed position.

The cart frame 122 is preferably manufactured from lightweight materials, yet sturdy enough to support the weight of multiple items of luggage. By way of example, and not limitation, the cart frame 122 may be manufactured from strong and lightweight aircraft-grade aluminum, graphite/carbon-fiber, or molded using high-strength plastics. Although not shown in this illustration, the cart frame 122 can be configured to expand, as needed, by way of nested and telescoping members, or other equivalent mechanical structures.

In FIG. 2, the telescoping handle assembly 104 is shown, also in the deployed state. Once deployed, the ILCS, including multiple articles of luggage disposed on the luggage cart 102, can be transported by simply pulling, or pushing the handle 104. When stowed, the handle assembly 104 fits in the plenum 200. The handle assembly 104 includes an upper handle enclosure 202 and a lower handle enclosure 204. The upper and lower telescoping tube is joined with a collar 220 secured by a lock pin 208. A telescoping lock hole 210 is also shown, as well as a coupler 222. The lower telescoping tube 214 is coupled with a pivot tube 216. A return spring 218 and a handle assembly indexing boss 268 are also shown. The return spring causes the telescoping handle 104 to automatically return to its "home" position in the plenum 200 when released. Bumper 224 protects the luggage 100 and the handle assembly 104. Multiple rivets 242 secure the handle assembly 104 to the luggage body 106.

The various components of the telescoping handle assembly 104, may be manufactured out of different materials. The manufacturing materials should be chosen to correspond to the load carrying capacity of the ILCS configuration to which it is assembled. For example, in a small luggage configuration, where the amount of weight to be conveyed by the cart portion is relatively lightweight, the components of the telescoping handle assembly may be manufactured out of injection molded or thermoformed plastics. In configurations where the ILCS is designed to carry heavier loads, then the components may be made out of sturdier material, such as aluminum. In a similar fashion, the rivets 242 may be interchanged with equivalent mechanical fastening structures such as screws, mated screws/bolts, or even adhesives as appropriate.

Figure 3:
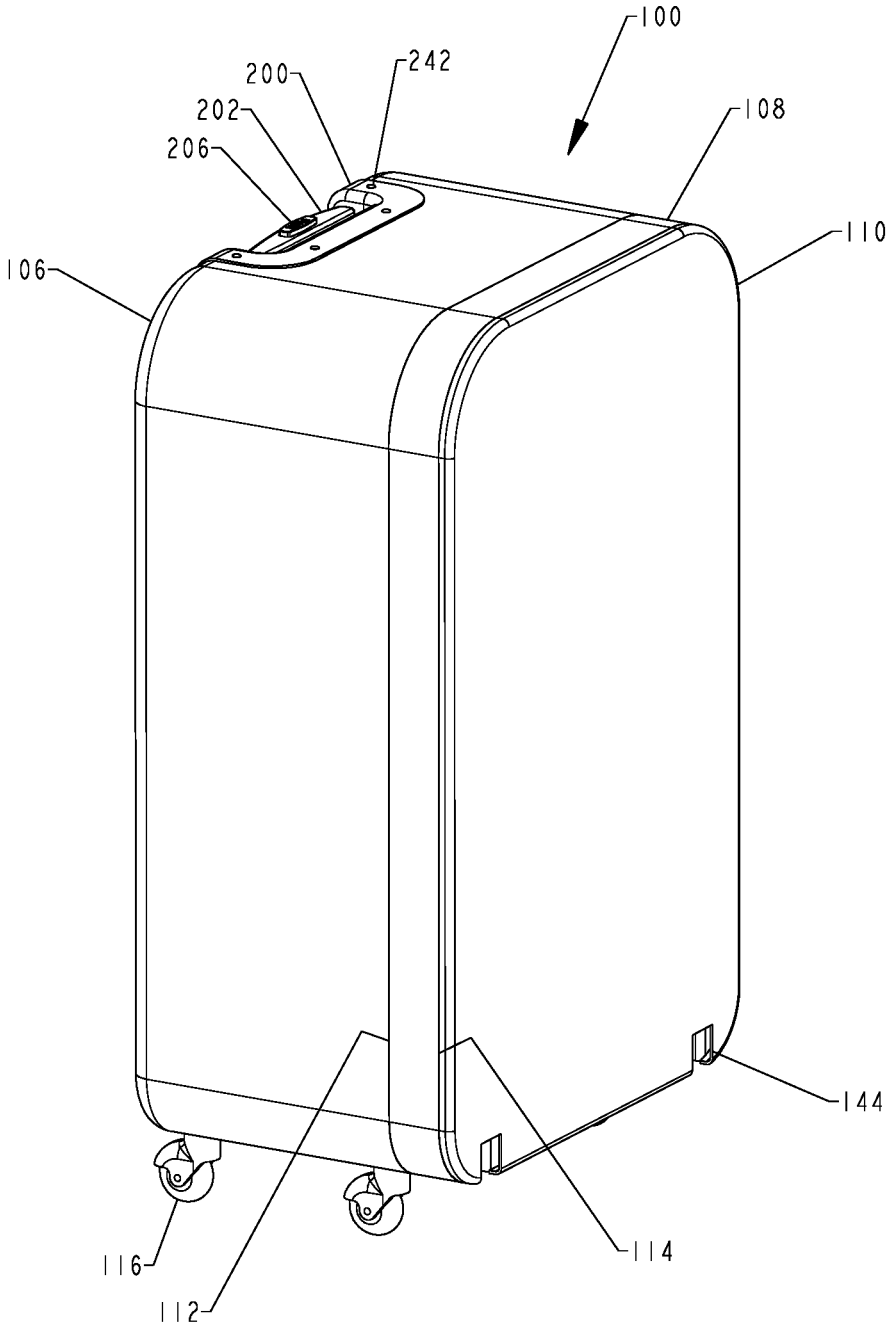
FIG. 3 shows a front perspective view of the ILCS with the luggage cart in the stowed state, according to an embodiment of the present disclosure.
Figure 4:
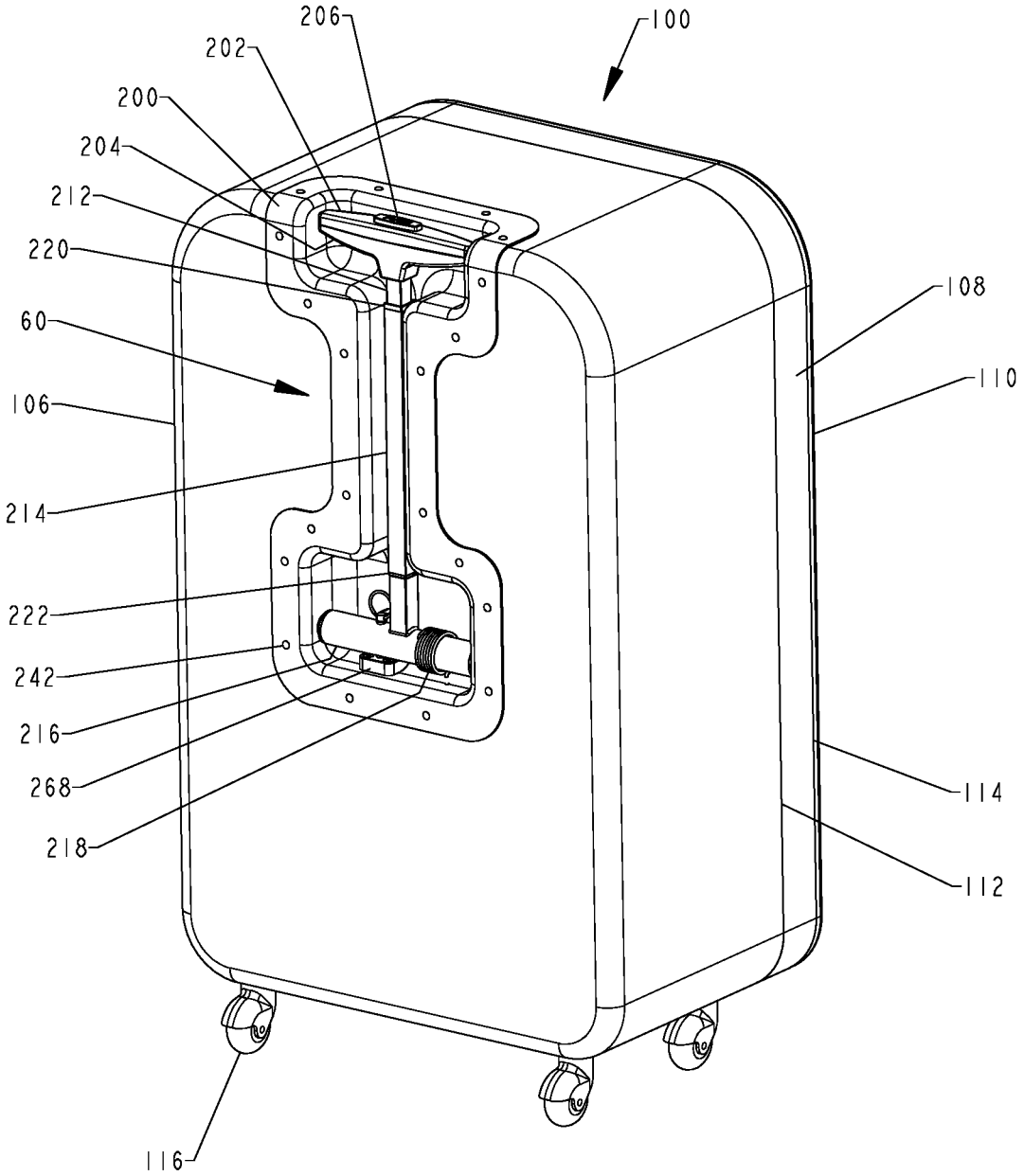
FIG. 4 shows a back perspective view of the ILCS of FIG. 3, according to an embodiment of the present disclosure.

FIGS. 3 and 4 show the ILCS in a closed state. These figures show the luggage cart 102 in the stowed state and hidden from view by the cover 110. The cover 110 can be a hard or soft cover, selectively removable, yet integral to the luggage 100. FIG. 4 shows the telescoping handle in the stowed position, nested within the plenum 200. One with knowledge in the art will appreciate that the plenum 200 shown in FIG. 4 is just one configuration for stowing the handle assembly 104 when not in use.

Figure 5:
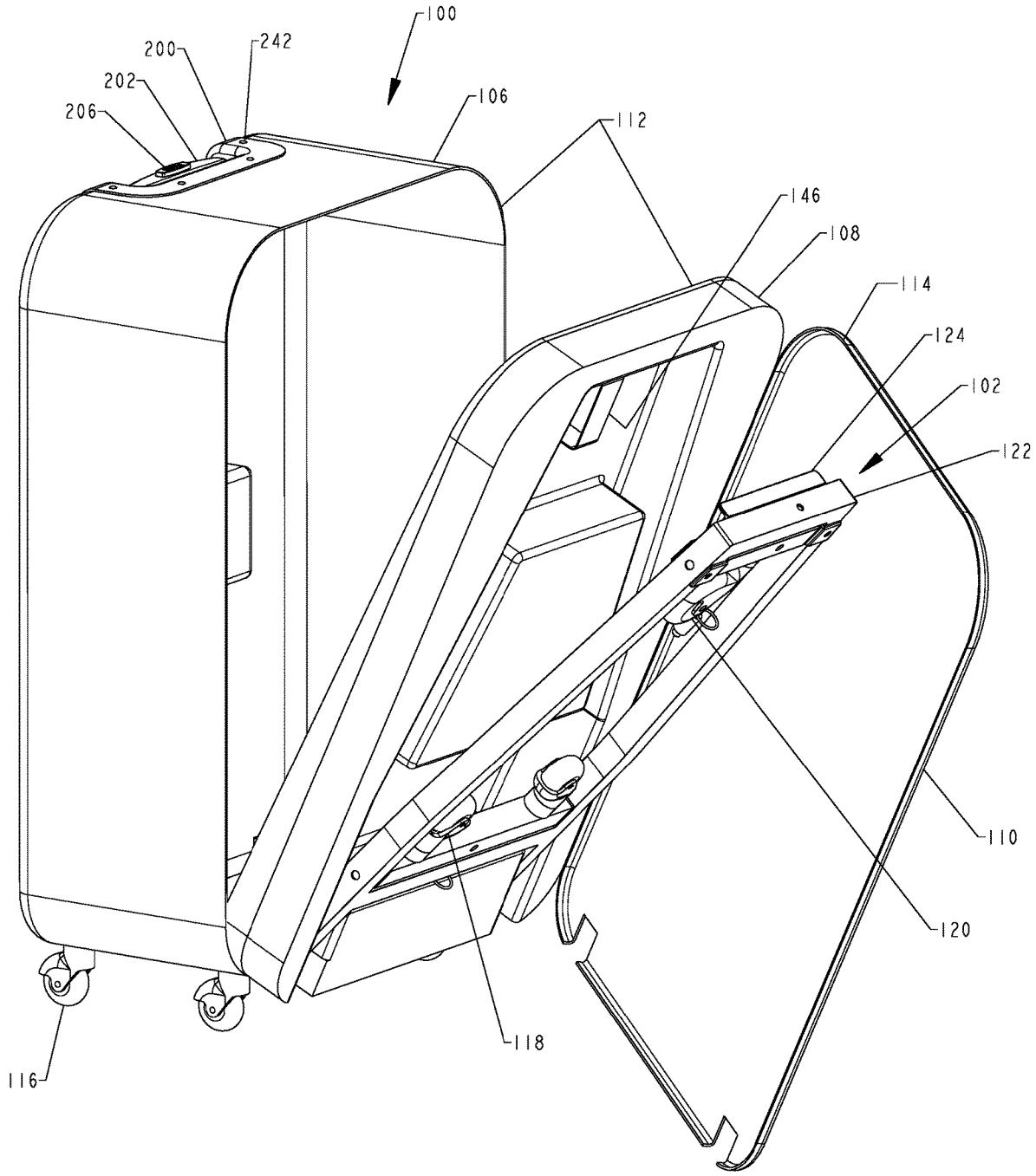
FIG. 5 shows a partially deployed ILCS, according to another embodiment of the present disclosure.

FIG. 5 shows the luggage cart 102 partially deployed. In this illustration, the cover 110 is open, revealing the luggage cart assembly 102. In this embodiment, the luggage cart wheels are in a stowed position. The wheels can be rotated to the deployed position so that when the luggage cart assembly 102 is fully extended, the luggage cart assembly 102 is supported by the wheel assembly.

FIG. 5 additionally illustrates that the luggage lid 108 is hinged along the bottom edge, closest to the cart pivot point. The luggage lid 108 can remain closed when the luggage cart assembly 102 is deployed, but also open to allow for easy access to the interior of the luggage 100 even when the cart 102 is deployed.

Figure 6:
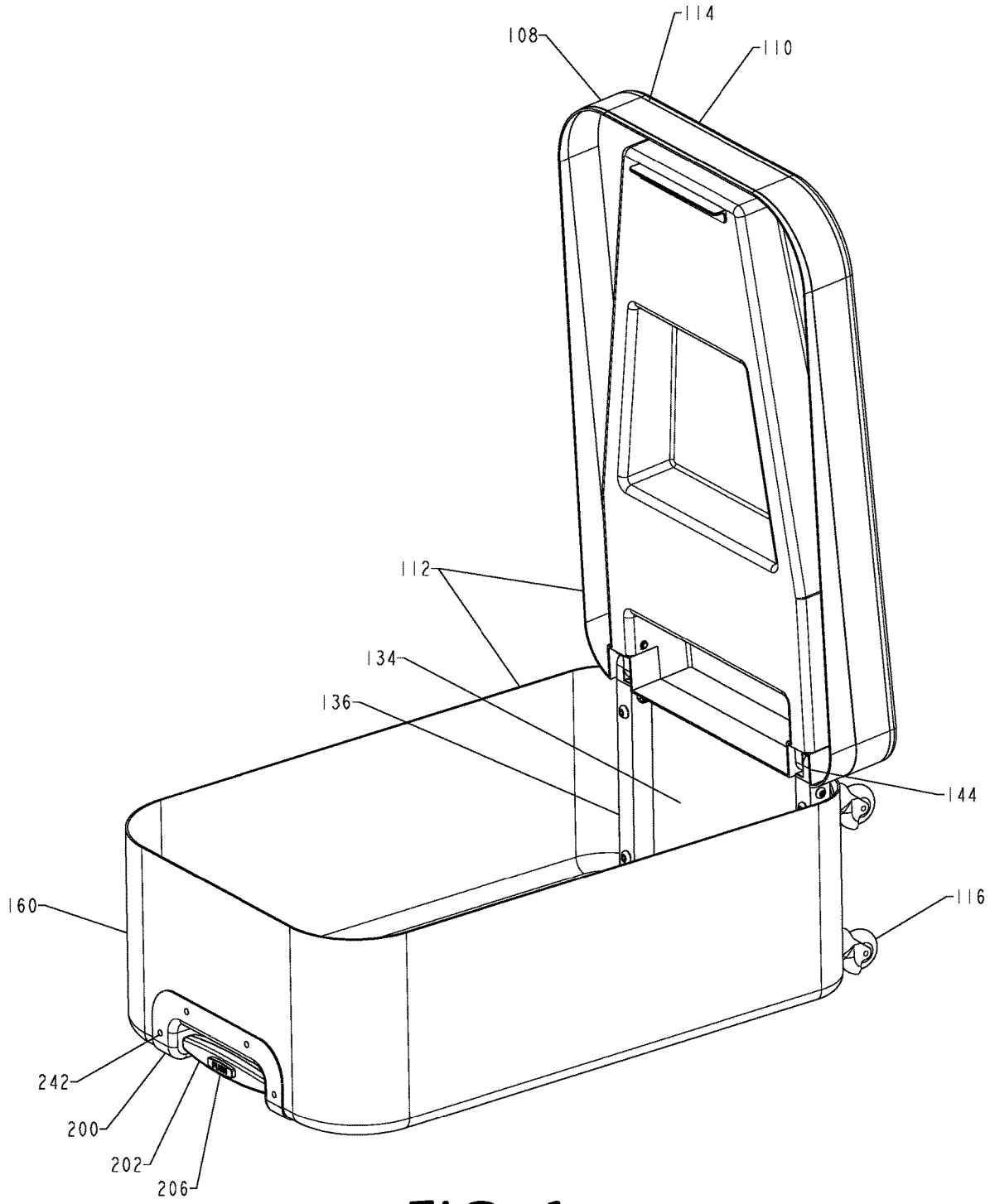
FIG. 6 shows an opened article of luggage, according to an embodiment of the present disclosure.

FIG. 6 shows an open suitcase, providing one view of how the frame of the luggage cart assembly 102 nests within the inside of the suitcase and occupies only minimal space within the luggage interior compartment.

Figure 7:
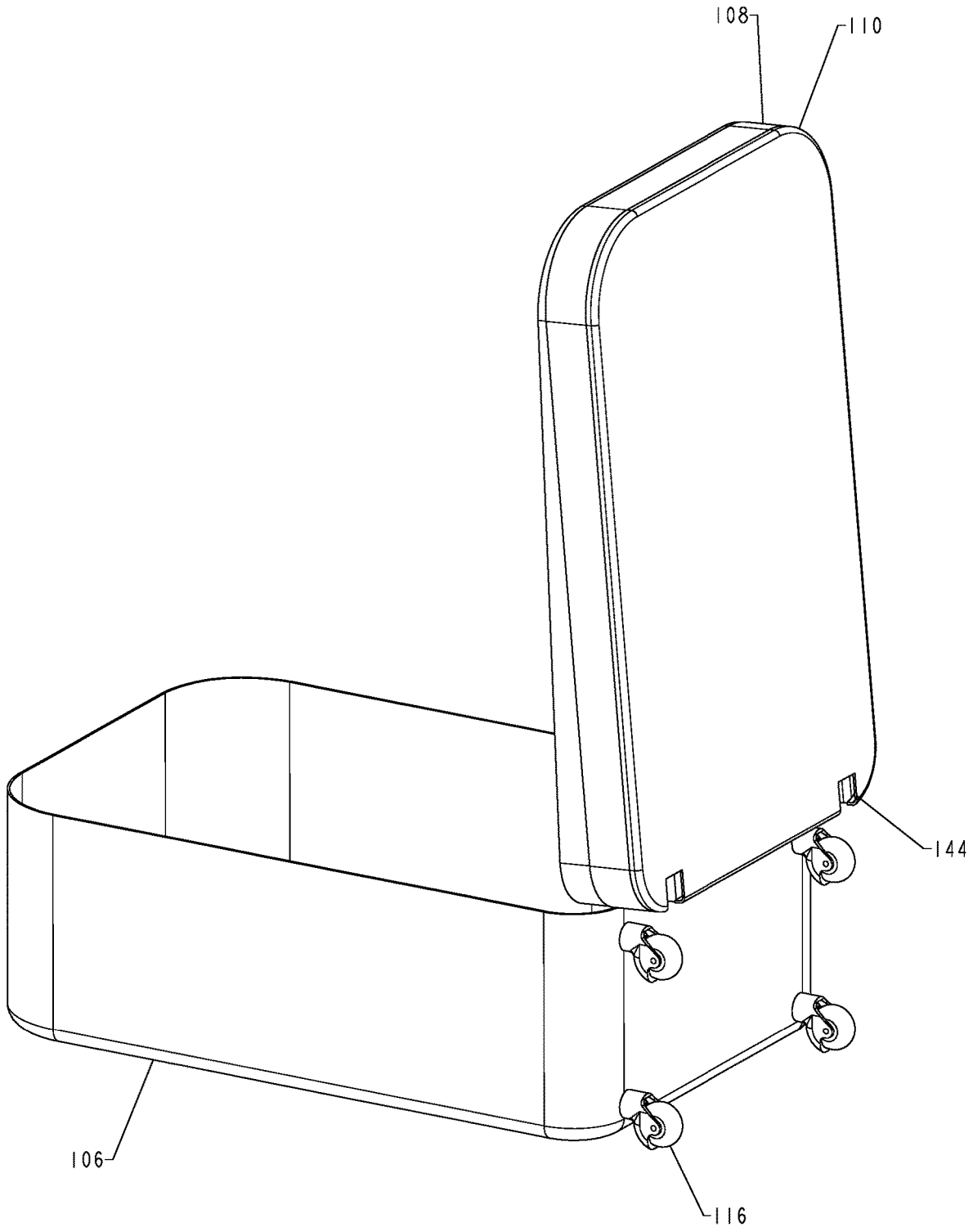
FIG. 7 shows a rear perspective view of the luggage of FIG. 6, according to an embodiment of the present invention.

The view shown in FIG. 7 provides one example of how the suitcase is indistinguishable from a standard suitcase when the cover 110 is closed over the stowed luggage cart 102.

Figure 8:
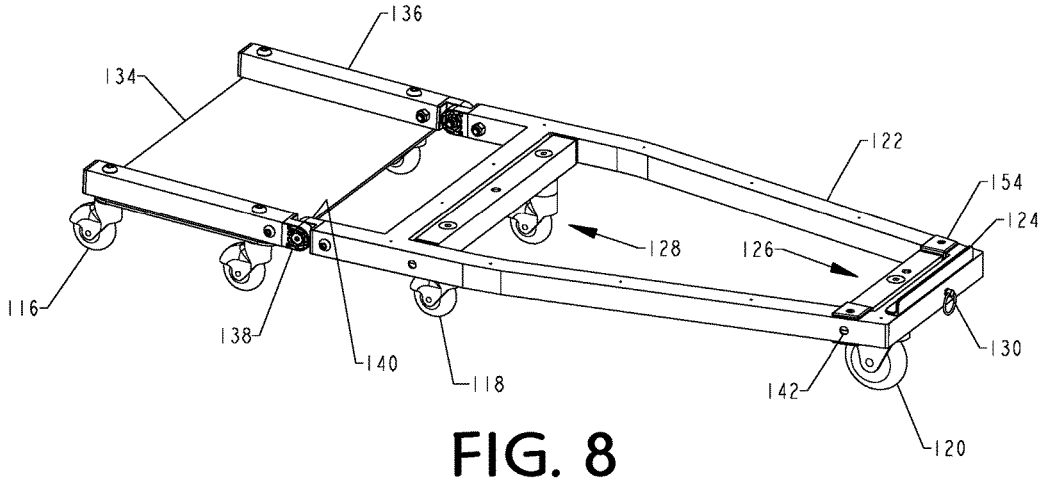
FIG. 8 shows a front perspective view of the ILCS internal cart structure, according to an embodiment of the present disclosure.
Figure 9:
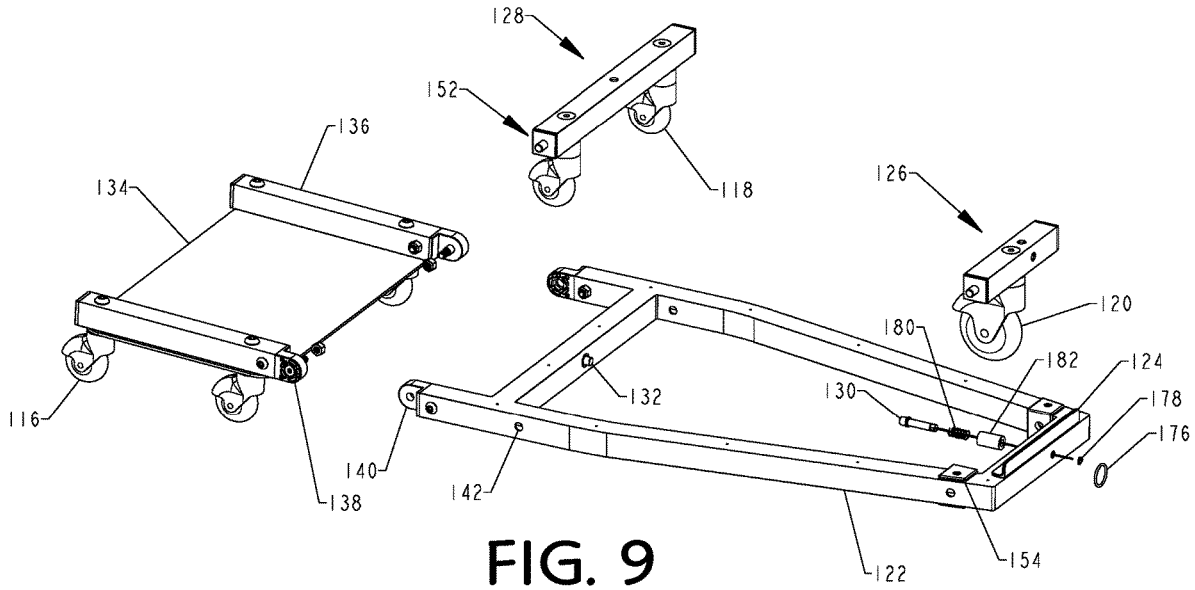
FIG. 9 shows an expanded view of the ILCS internal cart structure of FIG. 8, according to an embodiment of the present disclosure.

FIG. 8 shows a front perspective view of the structure of the luggage cart assembly 102. FIG. 8 shows one example of how the luggage cart 102 is mechanically coupled with the luggage 100. The frame 122 of the luggage cart 102 is attached to a bottom plate 134 which forms the bottom part of the luggage 100. FIG. 9 shows an exploded view of the luggage cart assembly 102 of FIG. 8.

Figure 10:
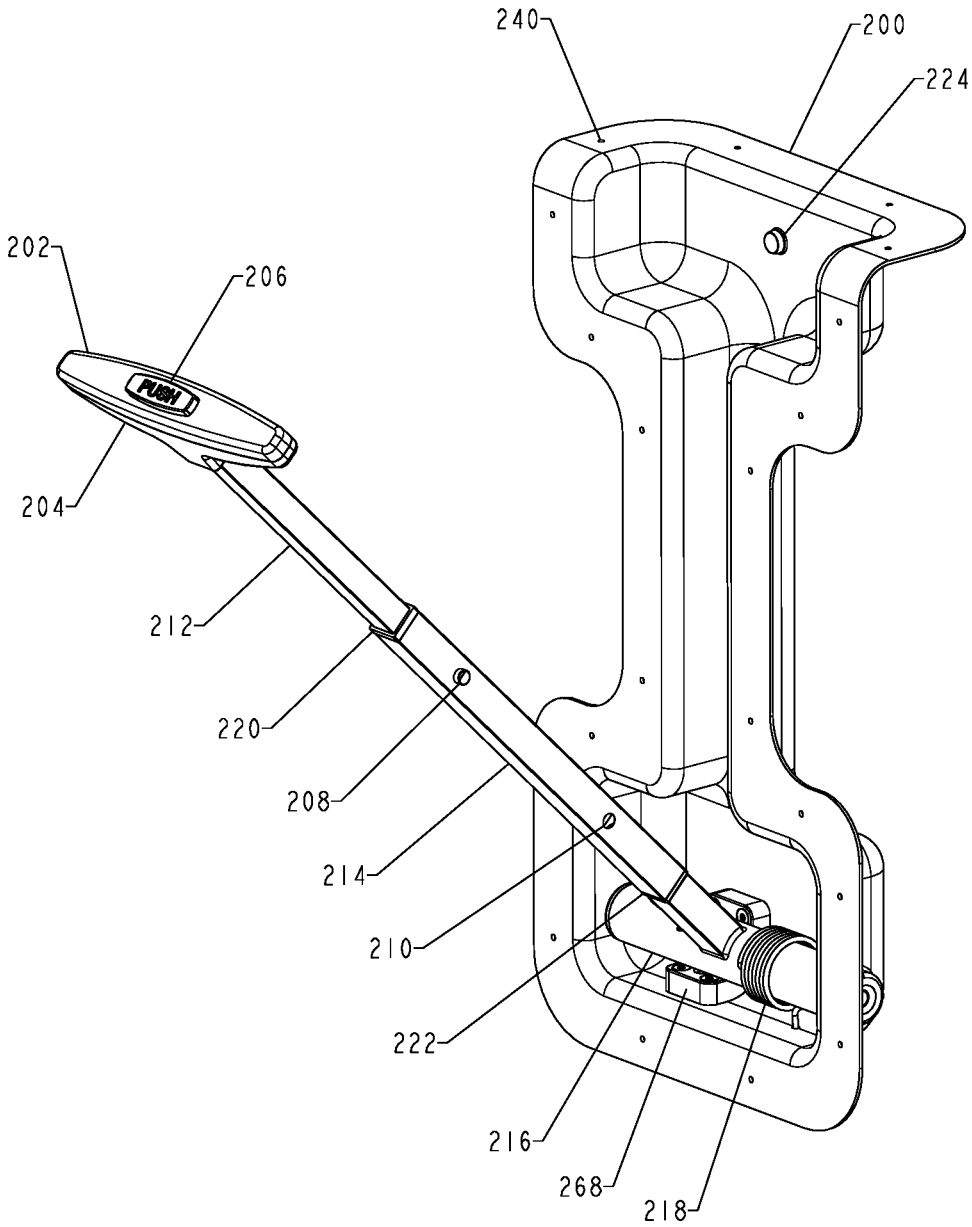
FIG. 10 shows a telescoping handle assembly and plenum structure, according to an embodiment of the present disclosure.
Figure 11:
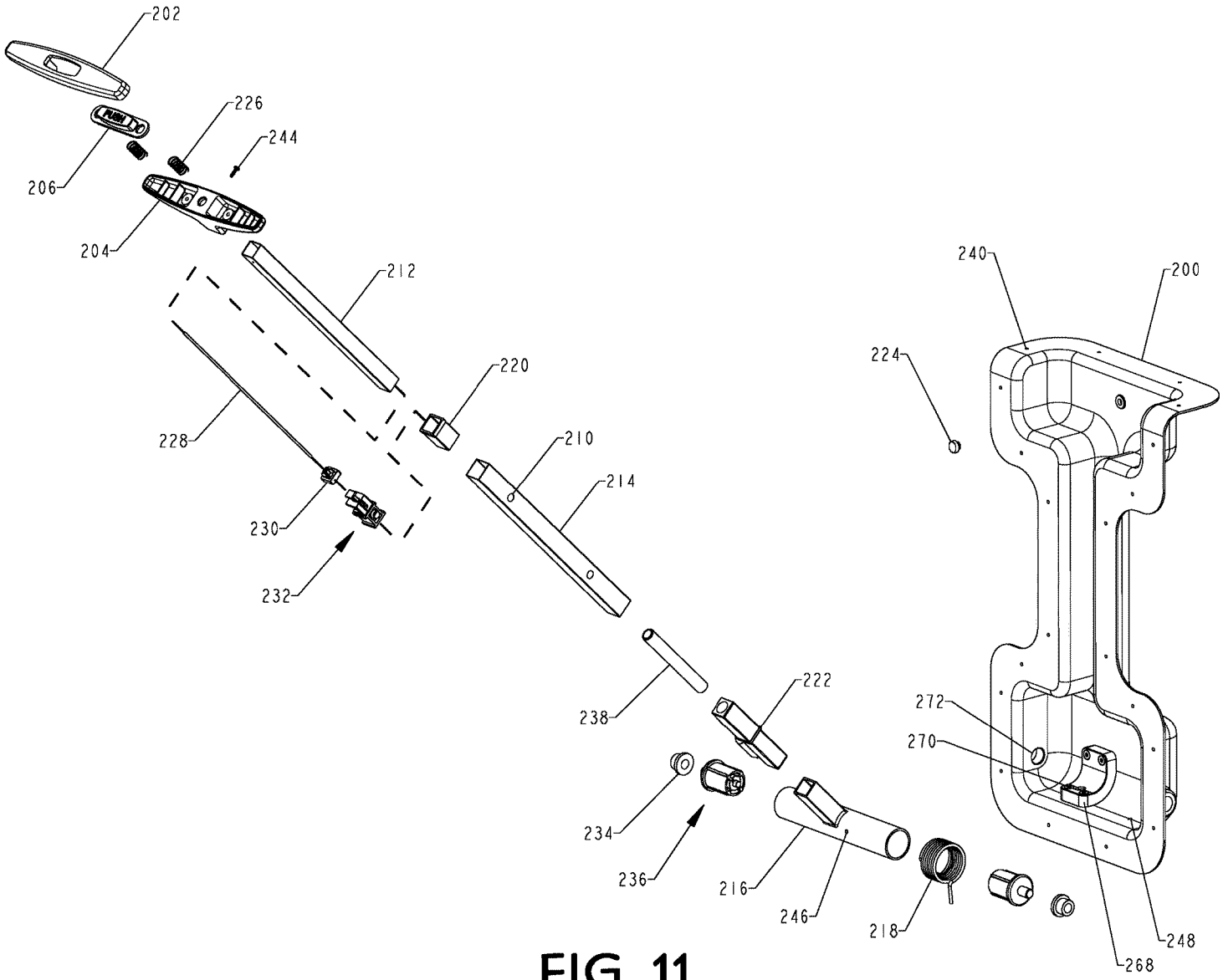
FIG. 11 shows an expanded view of the telescoping handle assembly of FIG. 10, according to an embodiment of the present disclosure.

FIG. 10 shows the telescoping handle assembly 104 and the plenum structure 200. The telescoping handle assembly 104 is shown in the deployed position. FIG. 11 shows an expanded view of the telescoping handle assembly 104 and also shows the plenum structure 200 of FIG. 10.

Figure 12:
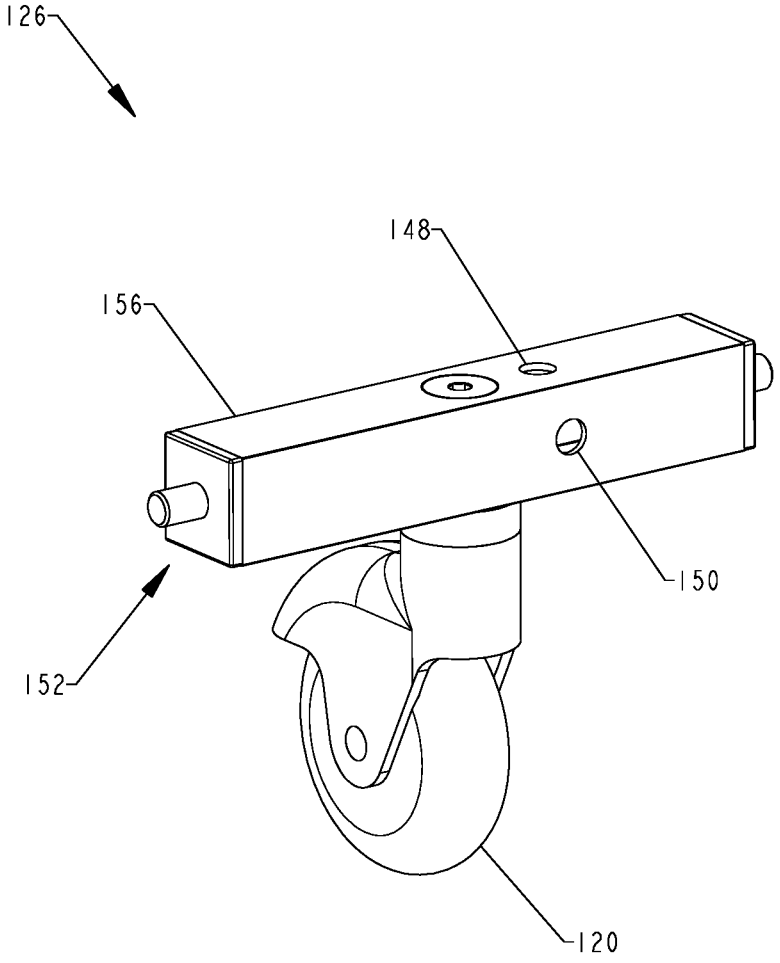
FIG. 12 shows a front wheel bracket assembly, according to an embodiment of the present disclosure.
Figure 13:
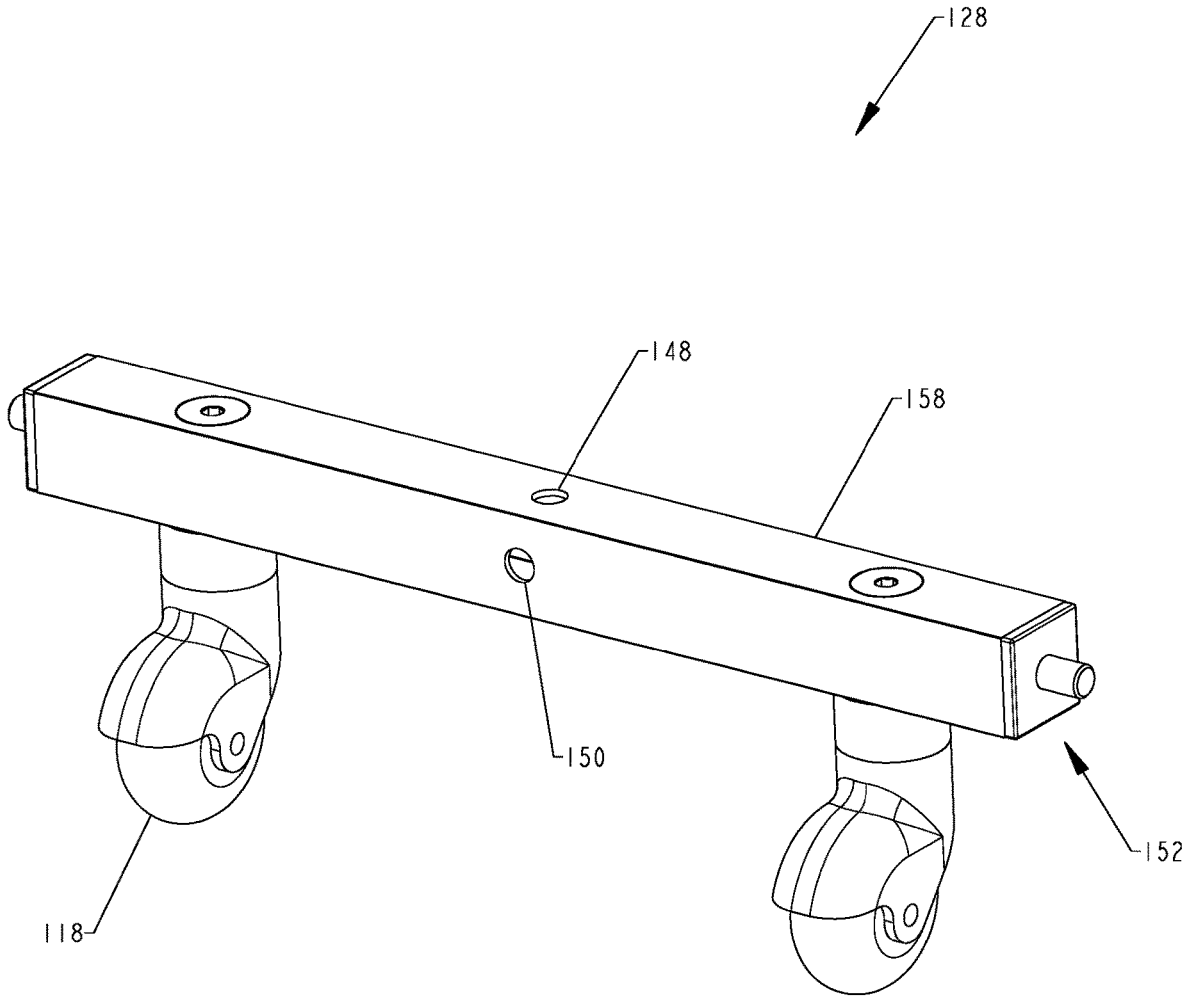
FIG. 13 shows a rear wheel bracket assembly, according to an embodiment of the present disclosure.
Figure 14:
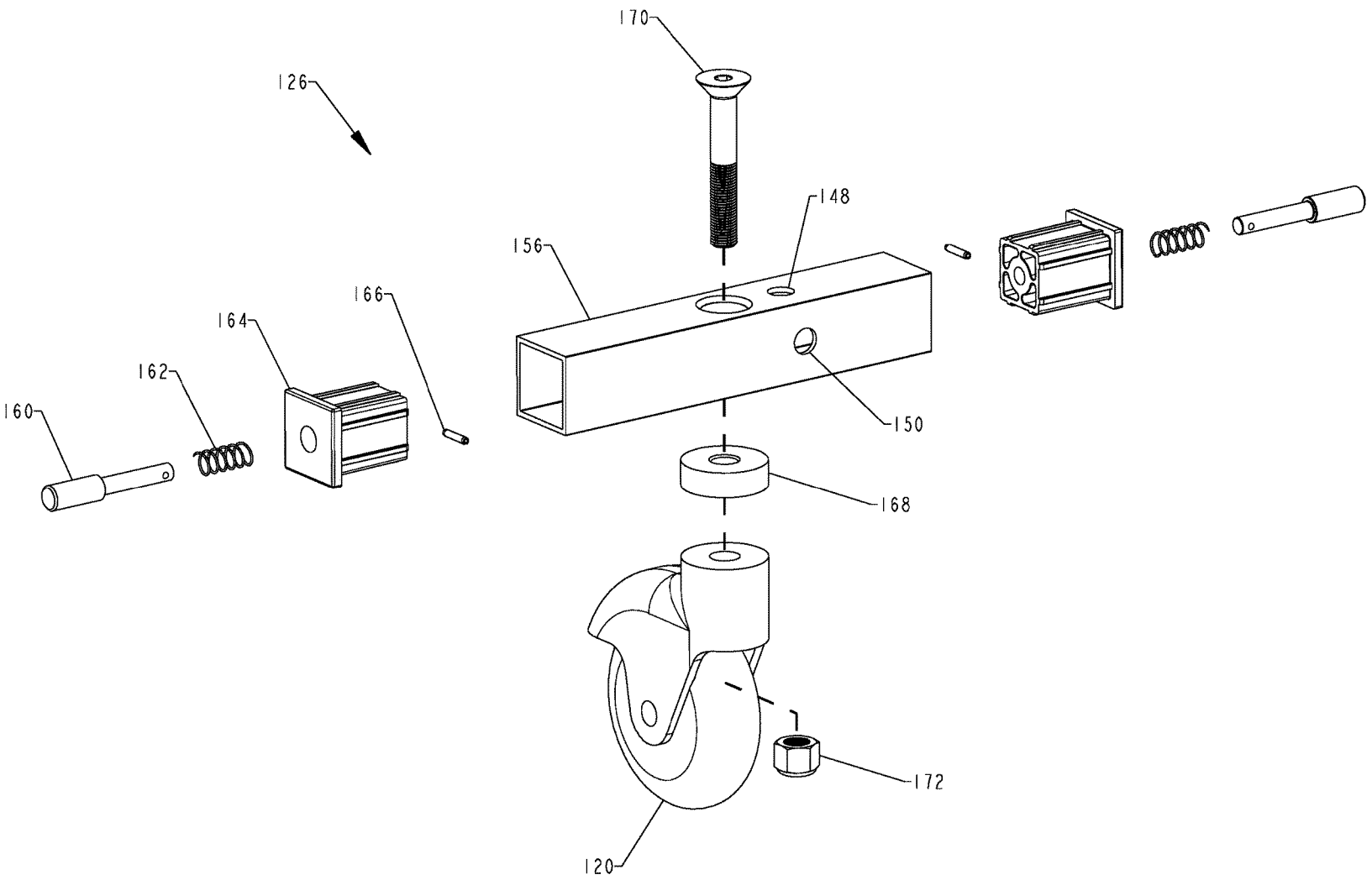
FIG. 14 shows an expanded view of the front wheel bracket assembly, according to an embodiment of the present disclosure.

Ease of mobility is one of the advantages of the ILCS 1. The luggage cart assembly 102 includes rotatable wheels (casters) that can pivot between a stowed and deployed position. FIG. 12 shows an example of a front wheel bracket assembly 126; while FIG. 13 shows an example of a rear wheel bracket assembly 128. The wheels shown in the drawings are shown for clarity of illustration and are not meant to limit the disclosure to the type of wheel shown. FIG. 14 shows an exploded view of the front wheel bracket assembly 126.

Figure 15:
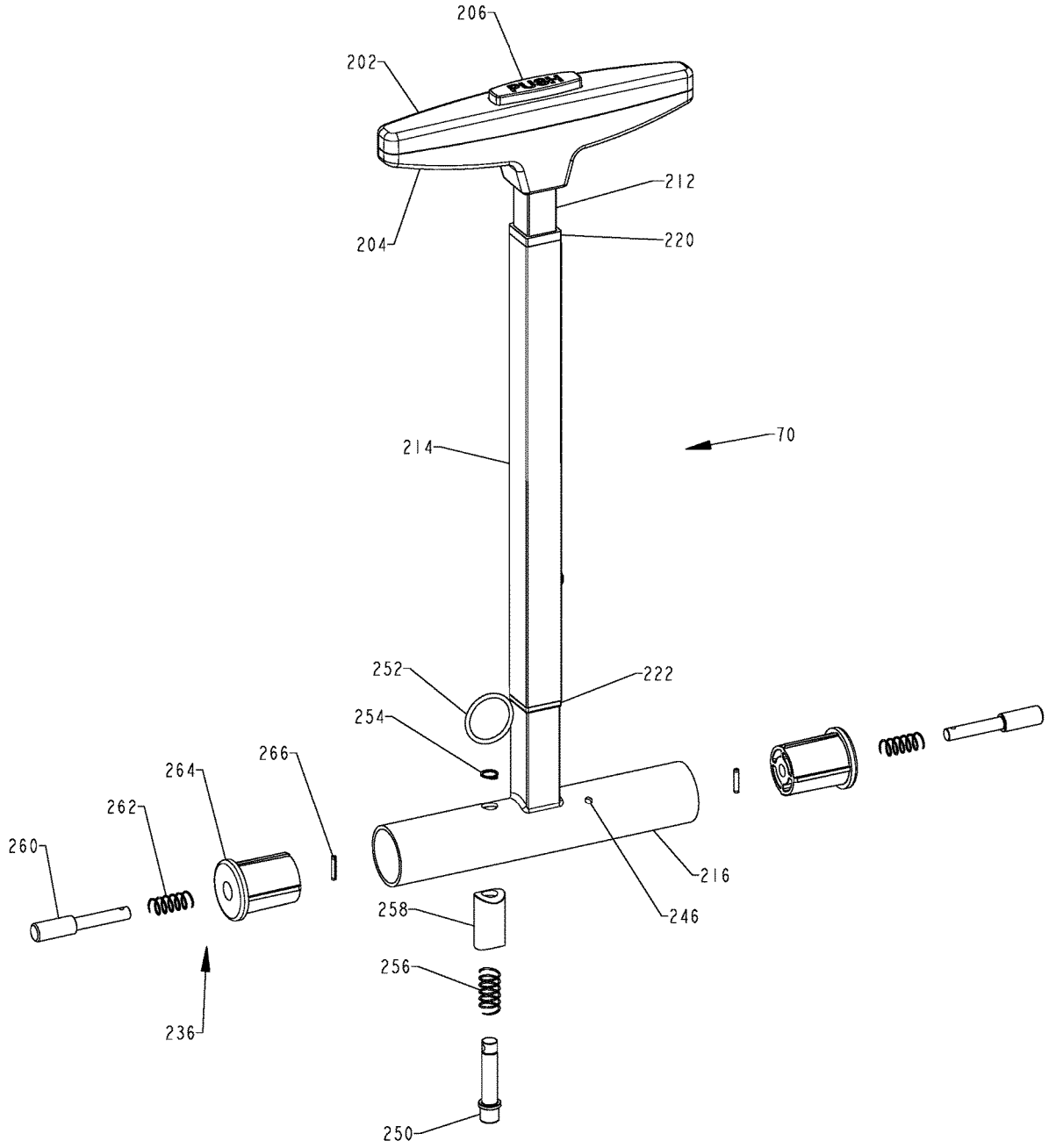
FIG. 15 shows an expanded view of the telescoping handle assembly, without plenum, according to an embodiment of the present disclosure.
Figure 16A:
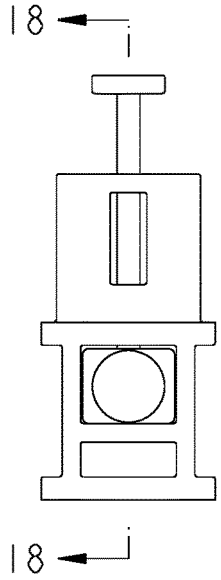

FIG. 15 shows an exploded view of the handle assembly 104 and the various components that make up the assembly 104. FIGS. 16, 16*a* and 17 show views of a lock pin mechanism 232 and its various components. FIGS. 18 and 19 show cross-sectional views of the lock pin mechanism 232. A preferred embodiment of the invention includes a mechanical structure that maintains the handle securely in the upright (stowed) position and, optionally, in the rotated (deployed) position. While the preferred embodiment described herein discusses a lock pin mechanism 232, it is to be understood that any acceptable locking or detent mechanism, mechanically equivalent to the lock pin mechanism 232 and as may be known in the art, lies within the scope of the present invention.

Therefore, while there has been described what is presently considered to be the preferred embodiment, it will understood by those skilled in the art that other modifications can be made within the spirit of the invention. The above description(s) of embodiment(s) is not intended to be exhaustive or limiting in scope. The embodiment(s), as described, were chosen in order to explain the principles of the invention, show its practical application, and enable those with ordinary skill in the art to understand how to make and use the invention. It should be understood that the invention is not limited to the embodiment(s) described above. Features from one embodiment can be used with another embodiment.

The invention claimed is:

1. An integrated luggage conveyor set comprising:

a luggage housing comprising:

a front panel with a cover;

a back panel;

two side panels;

a top panel; and a bottom panel;

a handle mechanism disposed on the back panel of the luggage housing; and a luggage cart assembly mechanically coupled with the luggage housing, the luggage cart assembly configurable between a stowed state and a deployed state, wherein the luggage cart assembly comprises:

a cart base, fixedly attached to the luggage housing bottom panel, with a cart base bottom, a cart base frame fixedly attached to the cart base bottom, having at least one cart base pivot location, and a plurality of cart base wheels attached to the cart base frame;

a cart frame with at least one cart frame pivot location at a cart frame proximal portion that is pivotally attached to the at least one cart base pivot location, the cart frame proximal portion adapted to receive a plurality of pivot pins, and where a cart frame distal portion is unattached and is adapted to receive a plurality of pivot pins in inserted relation;

a front wheel bracket assembly pivotally attached to the cart frame proximal to the cart frame distal portion, with a front wheel bracket having a plurality of pivot pins adapted to attach to the cart frame in inserted relation, and where the front wheel bracket is further configured with a front wheel stowed lock pin hole and a front wheel deployed lock pin hole, and a one or more front wheel pivotally attached to the front wheel bracket;

a front wheel bracket assembly lock shaft mechanically attached to the cart frame distal portion and adapted to be selectively inserted into either of the front wheel stowed lock pin hole and front wheel deployed lock pin hole;

a rear wheel bracket assembly pivotally attached to the cart frame proximal to the cart frame proximal portion, with a rear wheel bracket having a plurality of pivot pins adapted to attach to the cart frame in inserted relation, and where the rear wheel bracket is further configured with a rear wheel stowed lock pin hole and a rear wheel deployed lock pin hole, and a one or more rear wheel pivotally attached to the rear wheel bracket; and a rear wheel bracket assembly lock shaft mechanically attached to the cart frame proximal portion and adapted to be selectively inserted into either of the rear wheel stowed lock pin hole and the rear wheel deployed lock pin hole.

2. The integrated luggage conveyor set of claim 1 wherein the handle mechanism comprises a telescoping handle.

3. The integrated luggage conveyor set of claim 1 wherein the handle mechanism is stowed in a plenum of the back panel.

4. The integrated luggage conveyor set of claim 1 wherein the luggage cart assembly is adapted to be stowed flat against the front panel.

5. The integrated luggage conveyor set of claim 4 wherein the cover is adapted to be secured over the stowed luggage cart assembly.

* * * * *